US007230214B2

(12) United States Patent
Kirby

(10) Patent No.: US 7,230,214 B2
(45) Date of Patent: Jun. 12, 2007

(54) METAL SHEATHED HEATER USING SPLICE CONNECTION ASSEMBLY WITH HEAT SHRINKABLE TUBING, AND METHOD OF USE

(75) Inventor: Robert Kirby, Sparta, TN (US)

(73) Assignee: Tutco, Inc., Cookeville, TN (US)

( * ) Notice: Subject to any disclaimer, the term of this patent is extended or adjusted under 35 U.S.C. 154(b) by 3 days.

(21) Appl. No.: 11/064,845

(22) Filed: Feb. 25, 2005

(65) Prior Publication Data

US 2005/0194377 A1 Sep. 8, 2005

Related U.S. Application Data

(60) Provisional application No. 60/549,145, filed on Mar. 3, 2004.

(51) Int. Cl.
*H05B 3/08* (2006.01)
*H01R 4/00* (2006.01)
*H01R 43/00* (2006.01)

(52) U.S. Cl. ..... 219/535; 219/523; 219/541; 174/76; 174/84 R; 174/88 R; 29/621; 29/856; 29/869

(58) Field of Classification Search ..... 219/523, 219/535, 541; 264/408, 104, 230; 174/76, 174/84 R, 88 R; 29/621, 856
See application file for complete search history.

(56) References Cited

U.S. PATENT DOCUMENTS

| | | | | |
|---|---|---|---|---|
| 3,184,535 | A | 5/1965 | Worthington | |
| 3,387,364 | A | 6/1968 | Boggs | |
| 5,006,286 | A * | 4/1991 | Dery et al. | 264/408 |
| 5,393,932 | A * | 2/1995 | Young et al. | 174/84 R |
| 6,396,033 | B1 | 5/2002 | Renwick et al. | |
| 2002/0055300 | A1 | 5/2002 | Scherb | |
| 2004/0211770 | A1 | 10/2004 | Renwick et al. | |

FOREIGN PATENT DOCUMENTS

| | | |
|---|---|---|
| EP | 1 289 064 A2 | 3/2003 |

* cited by examiner

*Primary Examiner*—Robin Evans
*Assistant Examiner*—Stephen J. Ralis
(74) *Attorney, Agent, or Firm*—Clark & Brody

(57) ABSTRACT

A metal sheathed heater utilizes splice connections that connects ends of a heater cable with ends of a lead wire. Each splice connection has a connector that connects core wires of the lead wires and heater cable together. Heat shrinkable tubing surrounds the connector and ends of the heater cable and lead wires. An adhesive is interposed between the heat shrinkable tubing and heater cable and lead wire ends to bond with the heat shrinkable tubing and complete the splice connection. The metal sheath of the heater can be formed with an enlarged diameter portion to account for the heat shrinkable tubing surrounding the lead wire and heater cable ends.

14 Claims, 5 Drawing Sheets

METAL SHEATHED HEATER USING SPLICE CONNECTION ASSEMBLY WITH HEAT SHRINKABLE TUBING, AND METHOD OF USE

This application claims priority under 35 USC 119(e) based on provisional patent application No. 60/549,145 filed on Mar. 3, 2004.

FIELD OF THE INVENTION

The present invention is directed to a metal sheathed heater and a splice connection assembly therefore, and in particular, to the use of a heat shrinkable tube and adhesive combination for sealing the splice connection assembly.

BACKGROUND ART

The use of electric belly-band heaters is well known in the prior art. Typically, these heaters use resistance heating wherein a resistance heating wire or heater cable is encased in a metal sheath. The metal sheath is in contact with the item or material to be heated. One type of belly-band heater (commonly referred to as a "crankcase heater", "compressor heater" or "sump heater") is used to heat refrigeration compressors or air-conditioning compressors. The heater can employ a standard hose clamp or other type of clamping arrangement for attachment to the compressor. The standard hose clamp is cut in two pieces with each piece affixed (welded for example) to opposite ends of the heater's metal sheath. Assembly of the heater to the compressor is accomplished by engaging the two ends of the clamp as intended and then tightening the assembly around the selected compressor location. This type of heater construction can also be used for heating containers such as barrels, heating pipes, etc.

The belly-band heater has an insulated electric lead wire exiting each end of the metal sheath. A frequent requirement in the use of these heaters is for the lead wires to be routed in standard metal conduit. Further, it is often required that the conduit enclose the lead wires from the point where each lead exits the heater sheath to where the lead wires enter an electrical junction box or boxes.

FIG. 1 shows a typical metal sheathed heater or electric belly-band heater designated by the reference numeral 10 and including the hose clamp pieces 1 and 3, and the screw mechanism 5. A metal sheath 7 extends between the two pieces 1 and 3, with the hose clamp pieces attached to the sheath by welding or the like. The metal sheath 7 encases an electrically insulated resistance heating wire or heater cable 9 and includes a fluted strip portion 8, which interfaces with the equipment or material requiring heating and is more fully explained below.

In these types of metal sheathed heaters, it is well known in the industry that the heater cable is composed of resistance wire spiraled around a flexible core made of an electrically insulated and thermally resistant material such as fiberglass or other suitable material. This element is commonly referred to as a "heater core wire". After the heater core wire is uniformly coated with an insulating material having sufficient mechanical and electrical resistance properties so as to remain flexible yet electrically isolated, it is normally called a "heater cable". The insulating material is often silicone or a thermosetting plastic with adequate thermal properties for its intended use.

A small length of insulation is stripped from each end of the heater cable. Two flexible electrically insulated stranded lead wires with a small length of insulation stripped from one end of each wire are electrically connected, one to each end of the heater cable, by crimping or splicing the stripped ends of the heater cable to stripped ends of the lead wires. The connector used is a properly selected metal splice connector with sufficient temperature resistance, corrosion resistance, mechanical strength and formability to make a secure electrical bond.

In the prior art, a suitable material is molded around each metal splice joint to electrically isolate the metal connectors. The molding material is a substance which bonds with both the insulation of the heater cable and the insulation of the lead wire. The heater cable-lead wire combination, with molded insulation around the splice as described, is normally referred to as a "heater cable assembly". The heater cable assembly is enclosed in the metal sheath 7, see FIG. 1, which is commonly in the form of a tube, open at each end and of length sufficient to cover the heater core wire along its entire length. Generally the greater portion of the length of the two lead wires extends beyond the metal sheath to reach terminals so electrical power may be connected to each lead wire for activating the heater.

One version of a prior art metal sheathed heater is a Model CH made by TUTCO, Inc. of Cookeville, Tenn., see FIG. 1 again. The heater 10 is typically wrapped around and clamped in place on the outside of an air conditioning or refrigeration compressor to heat a substance such as compressor oil. While a hose clamp is illustrated, any type of attachment can be employed to secure the metal sheathed heater to the component desired to be heated. These arrangements are well known and do not need further description for understanding of the invention.

The heater cable 20, as shown in FIG. 2, is made with a heater core wire 21 having a fiberglass central core 23. The heater cable assembly 25 is made with the heater cable 20 and two stranded lead wires 26 and 28. At the splice, these components, all essentially having same outside diameter, see FIG. 3, are insulated with molded silicone 30, the mold matching the diameter of the wires and cable. The molding material used is silicone because this is the only known substance that will bond with the silicone used in the heater cable and lead wires and make an adequate terminal splice seal.

Presently, the requirement of encasing the lead wires in conduit is achieved by attaching specialized parts/items where the heater is being used so as to protect the lead wires and meet installation codes. This procedure is both time-consuming and costly. In conjunction with the special rigging required to meet the requirement of enclosing the lead wires at the heater itself, opposite ends of the conduit would also be attached to standard junction boxes or the like.

One of the problems with prior art heaters is the use of silicone wiring for the heater cable and lead wires. When silicone-insulated wires are manufactured, the wires are placed on take-up rolls during the wire production process. To prevent the silicone insulation on the wires from sticking during the take up roll process, a thin layer of powdered talc is applied to coat the wire surfaces. The talc must be removed from the splice section prior to a molding process as the talc will contaminate the cross section area of the cut surfaces formed during the insulation stripping process. The presence of talc prevents the silicone mold material from sticking to the cut cross section surfaces of the wire insulation.

During the process of stripping insulation from the ends of the wires and the process of connector splicing, it is possible for pieces of fiberglass to contaminate the area.

Also, the ends of the resistance wire and/or the ends of the stranded lead wires may not be properly captured by the splice connector. An example of this is shown in FIG. 4 wherein a portion of the heater core wire 21 lies outside the connector 32. In order to detect and then correct the aforementioned conditions prior to molding, intense manual inspection is performed on each splice joint and rework is done as required, both assisted by visual magnification.

Referring to FIGS. 5*a* and 5*b*, the sheath 40 for the heater is made by a thin metal strip tightly wrapped around the periphery of the heater cable and cable assembly. The metal strip is slightly wider than the circumference of the heater cable and slightly longer than the heater cable which is centered along the sheath length. Each lead wire is of sufficient length to extend to electrical power terminals. Special "fingers" 41, all the same width, are stamped along each side and at a direction perpendicular to the centerline of the length of the strip. Spaces 43 between the strips are created and the fingers 41 are of the same dimension. The strip is initially made in a flat form, see FIG. 5*a*, and is preformed into a "U" cross section 45, see FIG. 5*b*, prior to the operation of wrapping the metal strip around the heater cable assembly. The "fingers" 41 on one side of the strip are offset when compared to those on the opposite side so all will interlock once the strip is formed into its intended final shape, see FIG. 1. Each space is slightly wider than the width of each "finger" to create a loosely interlocked condition after the metal strip is wrapped around the heater cable assembly. Finally and as shown in FIG. 1, a two-piece metal clamp arrangement is welded to the formed metal sheath, one piece to each end of the sheath, and the entire heater assembly is formed to fit the shape of the compressor for which it was designed. Referring to FIG. 1, it can be seen how the "fingers" loosely interlock and contact the compressor body to enhance heat transfer.

Referring again to FIG. 3, the mold covering 30 of the splice connector section 25 is designed to be at the same outside diameter as the two adjacent wires 20 and 26 connected by the splice. This ensures sufficient insulation between the metal connector and the metal sheath. Also, if the mold section is at a diameter larger than that of the wires, the mold section 30 can or will be cut when the metal sheath is formed around the assembly resulting in either improper heater operation or failure. There must be no breaks, cracks or any path whereby current can leak to the metal sheath, either from the live electric splice connectors or from the live resistance wires of the heater cable immediately adjacent to the splice section. Such a flaw can result in either improper operation or failure of the heater.

For the TUTCO, Inc. model CH compressor heaters, secure mold sections on each heater built are essential for proper operation. However and during the manufacture of these CH model heaters, a number of hard to identify conditions can occur that, if are not detected prior to using, the heater can fail. These conditions could be breaks, cracks or incomplete bonding between the wire insulation and the mold material resulting in heater failure. Also, should either the end of a heater core wire or the end of a lead wire strand protrude outside the splice connector and extend a distance equal to or greater than the distance to the outer surface of the molded section, a direct electrical path to the metal heater sheath is created resulting in heater failure, (See FIG. 4). Further, if either a piece of fiberglass from the core wire or some of the powdered talc used to coat the silicone insulation becomes imbedded in the mold area, a defect can occur resulting in heater failure.

Another hard to identify defect is either very tiny holes or cuts in the heater cable adjacent to the mold sections that are not sealed by the molding silicone. The holes and cuts occur either when the wires are cut to length, insulation stripped from their ends or when the metal connector is spliced to the wires during the process of connecting the heater cable ends to the lead wire ends. These holes and cuts result when the tools used in performing these operations becomes worn or out of adjustment and impinge on the insulation covering the wires with sufficient force to cut through to the metal underneath.

It does not work to cover all the defect types mentioned above by making the mold section to a diameter larger than the wire diameter and extend it to cover any possible holes or cuts in the insulation as mentioned above. This is because molded sections, larger in diameter than the wires, will be cut and rendered defective when the metal sheath is applied as described above. The same is true if an insulating tube or tape is placed over the potentially defective area and the sheath closed as intended.

Another problem with the prior art is that it is not possible to use lead wires with insulation other than silicone because only silicone will bond to silicone. Other lead wires are available and made with insulating materials that are tougher than silicone, have temperature ratings high enough for heater lead wire applications and are less expensive than silicone. Often times, the ends of the formed sheath have sharp edges and when the heater is installed in its intended location it is possible for the soft silicone lead wire insulation to accidentally be forced against a sharp edge cutting deep enough to create a defect.

As a result of the problems encountered concerning the splice connection of the prior art metal sheathed heaters, a need exists to provide an improved splice connection. The present invention solves this need by providing a splice connection that eliminates the need for using a silicone molding compound and molding operation for the splice connection, and avoids many if not all of the problems noted above regarding the prior art metal sheathed heaters.

SUMMARY OF THE INVENTION

A first object of the present invention is an improved metal sheathed heater.

Another object of the invention is a metal sheathed heater that employs an improved splice connection utilizing heat shrinkable tubing and an adhesive.

Yet another object of the invention is a metal sheathed heater that employs at least lead wires that do not use silicone as insulating material, thus allowing the lead wires to be made with tougher resistance to cutting and, if desired, smaller diameter. Cost savings are also realized by the elimination of costly silicone.

The present invention also involves modifying the sheath to accommodate the improved splice connection of the invention by forming enlarged diameter sections prior to surrounding the splice connection with the metal sheath.

Other objects and advantages of the present invention will become apparent as the description thereof proceeds.

The invention is an improvement in heaters employing a metal sheath encasing a heater cable, a clamp assembly attached to ends of the metal sheath for securing the metal sheath to a component for heating purposes, lead wires, and a splice connection where each end of the heater cable connects to a respective end of each lead wire. According to one aspect of the invention, heat shrinkable tubing and an adhesive are employed to form the splice connection in place of the prior art use of silicone molding compounds. The adhesive surrounds end portions of the lead wire and heater cable and the connector linking the wire core of the heater cable and strands of the lead wire. The adhesive can be a type that bonds or does not bond to the insulation of the lead wire and/or the insulation of the heater cable. Preferably, the adhesive is of the type that bonds to the lead wire so that pulling forces applied thereto can be transmitted to the heat shrinkable tube, and not the connector.

While the heater cable and lead wire can have the same insulation, the lead wire can have a different insulation such as a non-silicone type, thereby allowing more durable, smaller diameter, and/or less expensive lead wires to be employed as part of the metal sheathed heater.

In another aspect of the invention, a section of the metal sheath surrounding the heat shrinkable tubing can have an enlarged diameter as compared to remaining sections surrounding the heater cable, thus accommodating the increased diameter section of the splice connection.

The invention also entails a method of making the metal sheathed heater by first applying an adhesive to a connector connecting each insulated lead wire end and insulated heater cable end, and then encasing the connector and ends with a heat shrinkable tubing. As an optional step if necessary, enlarged diameter sections near opposite ends of the metal sheath can be formed to receive the respective splice connections. The choice of adhesive can vary depending on whether it is desired to form a bond between the adhesive and insulation being used for either or both of the heater cable and lead wires.

The invention also includes the splice connection for each end of an insulated heater cable and an end of an insulated lead wire wherein a connector links one end of the heater cable with one end of the lead wire. The splice connection comprises an adhesive covering the connector, the end of the lead wire, and the end of the heater cable. The heat shrinkable tubing covers the connector and ends of the heater cable and lead wire, the tubing being bonded to the adhesive. The insulation of the lead wire and insulation of the heater cable can be one of the same material with the material being silicone; different materials with the heater cable insulation being silicone; and the same material with each not being silicone. Preferably, the insulation of the heater cable is silicone, and the insulation of the lead wire is a material different from silicone. Another preference is to employ lead wires that have more durable properties than lead wires having silicone insulation, and as such, smaller diameter lead wire can be utilized for additional cost savings.

BRIEF DESCRIPTION OF THE DRAWINGS

Reference is now made to the drawings of the invention wherein.

DESCRIPTION OF THE PREFERRED EMBODIMENTS

The present invention offers significant improvements in the field of metal sheathed heaters, including the heaters themselves, and their methods of making and using. By eliminating the molding operation using a silicone compound to insulate the splice connection surrounded by the metal sheath, tougher lead wires can be used, improved pulling resistance can be obtained, improved sealing and protection of the splice area are realized, and costs are reduced by eliminating silicone lead wires.

Figure 6:
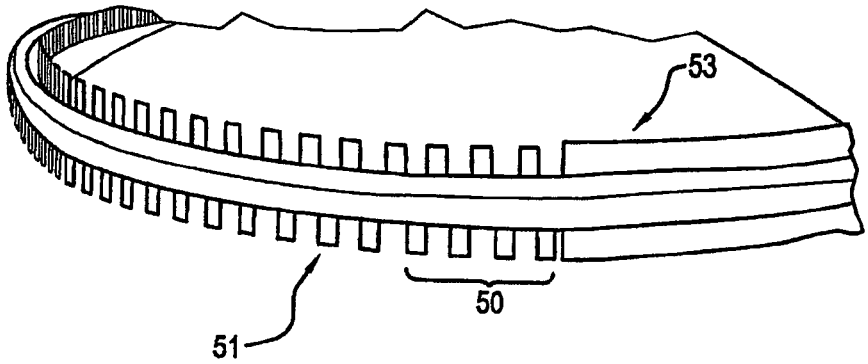
FIG. 6 shows a section of a metal sheath according to the invention.

FIG. 6 shows one aspect of the improved metal sheathed heater, wherein a section 50 near the end of a metal sheath 51 has a diameter slightly larger than the remainder of the sheath. This drawing also shows the clamp end 53 welded to an end of the sheath. It should be noted that the welding operation wherein the clamp end and teeth are welded together causes the teeth to become part of the clamp end. This same enlarged diameter section 50 is found on the opposite end of the metal sheath, where the other half of the clamp is located. Preferably, the length of the enlarged diameter section approximates the length of the heat shrinkable tube that is used to make the splice connection as described below.

Figure 1:
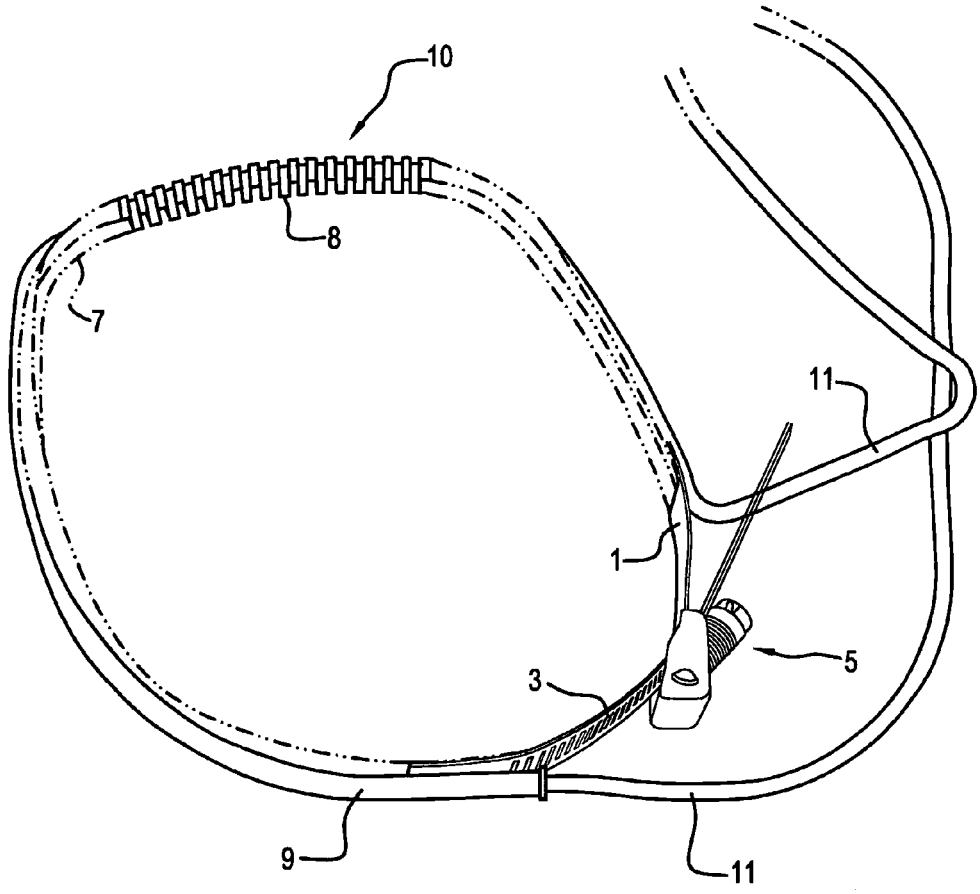
FIG. 1 PRIOR ART
FIG. 1 is a perspective view of a prior art electric metal sheathed heater.
Figure 2:
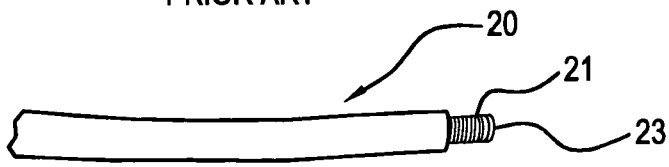
FIG. 2 PRIOR ART
FIG. 2 shows a cut away part of a prior art heater cable.
Figure 3:
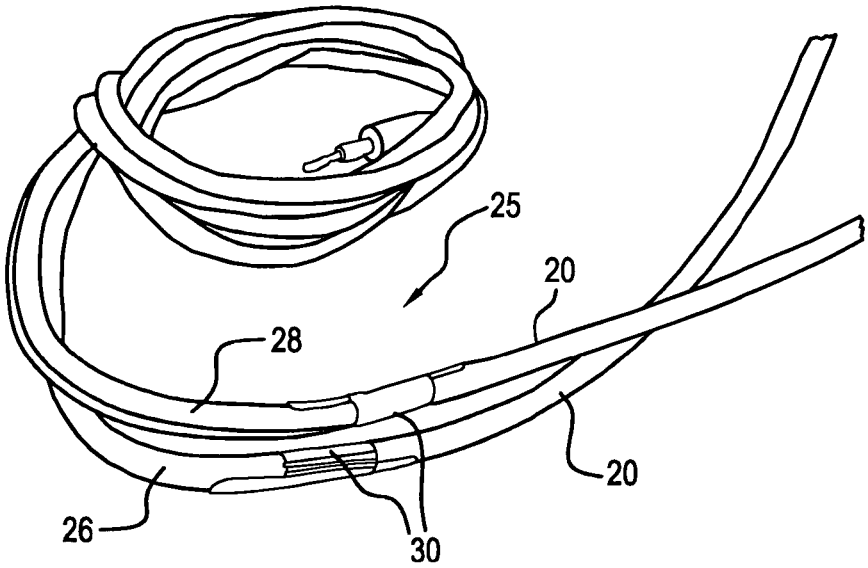
FIG. 3 PRIOR ART
FIG. 3 is a prior art splice connection using molded silicone to enclose the splice connection.
Figure 4:
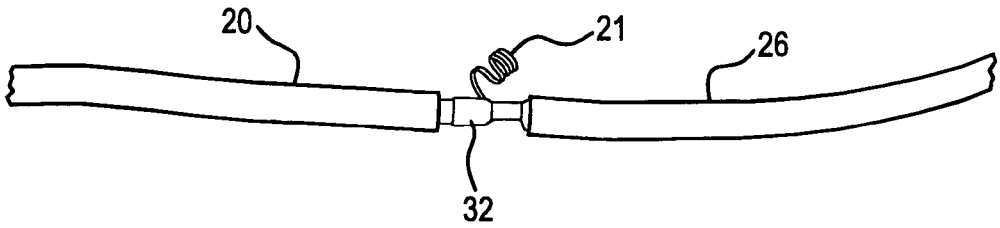
FIG. 4 PRIOR ART
FIG. 4 is a prior art splice connection with a faulty splice.
Figure 5A:
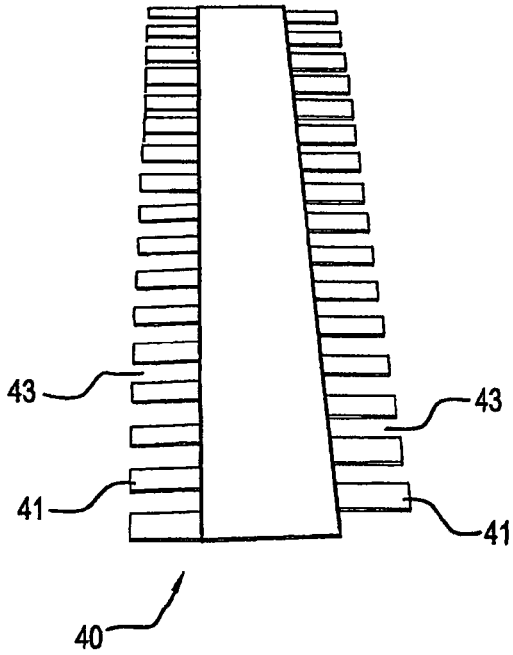
FIG. 5a PRIOR ART
FIGS. 5*a* and 5*b* show a prior art metal sheath in the flat state and the partially formed state, respectively.
Figure 5B:
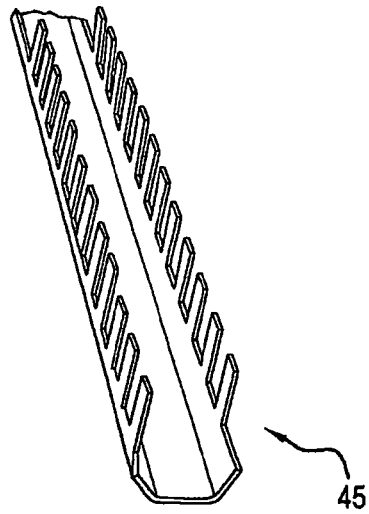
FIG. 5b PRIOR ART

The enlarged diameter portion is formed as part of the sheath forming operation. Referring back to FIG. 5, when the metal sheath 51 is formed into the U-shape to receive the heater cable, the section 50 is expanded more than the remainder of the sheath so as to enlarge its diameter. This expansion creates more space for the splice connection when the metal sheath and linked heater cable and lead wire are assembled.

Figure 7A:
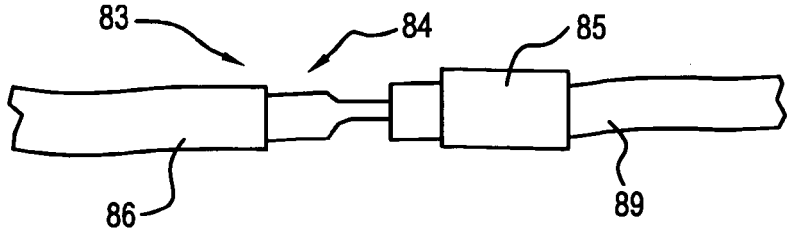
FIGS. 7*a*–7*c* show the inventive splice connection in various stages of formation.

FIGS. 7*a*–7*d* shows various stages of wire assembly and two different embodiments of the splice connection of the invention. FIG. 7*a* shows one embodiment of the invention as reference numeral 83 in a first mode of assembly. That is, an exposed connection 84 is shown between the lead wire 89 and heater cable 86. The lead wire 89 and the heater cable 86 are of the same diameter in this embodiment. Heat shrinkable tubing 85 is shown surrounding the lead wire 89 and positioned adjacent to the connection 84.

Figure 7B:
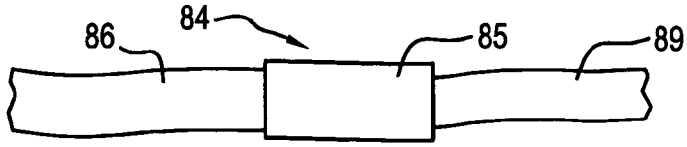

In FIG. 7*b*, a second mode of assembly is illustrated, wherein the heat shrinkable tubing 85 is positioned around the connection 84 for a subsequent application of heat.

Figure 7C:
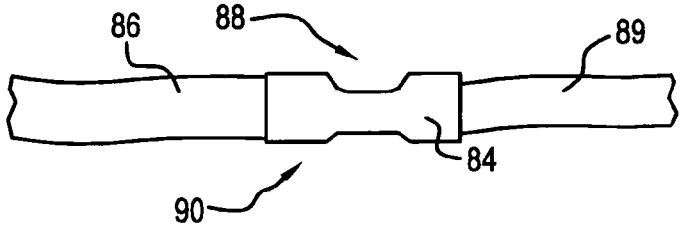

FIG. 7*c* shows the assembly of the wires 86 and 89 after the connection 84 is subjected to heat. The heat shrinkable tubing 85 is shrunk around the connection 84 resulting in a reduced diameter portion 88. The completed splice connection 90 is ready for assembly with the metal sheath 51 to form the metal sheathed heater.

Figure 7D:
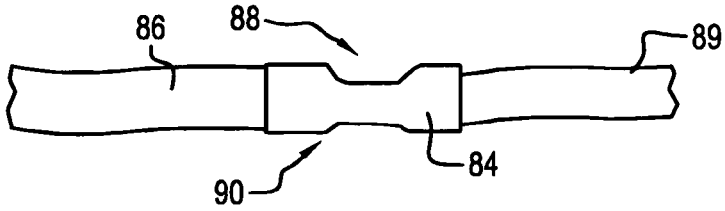
FIG. 7*d* shows an alternative embodiment of the splice connection of FIGS. 7*a*–7*c;*

FIG. 7*d* shows an alternative completed splice connection utilizing a smaller diameter lead wire, shown as 89'. The smaller diameter lead wire 89' is representative of the non-silicone insulating types. By the use of the heat shrinkable tubing connection, the prior art necessity of connecting silicone to silicone wires is removed, and more durable wires employing smaller diameters and their attendant savings in cost can be employed as part of the metal sheathed heater.

Once the splice connection 90 is completed, the connected-together lead wire 89 and heater cable 86 can be formed into a metal sheathed heater for use around a compressor or like as is known in the art.

The heat shrinkable tubing 85 is in the form of a plastic tubing of characteristics that it is made of a material that will, under heat, shrink to a predetermined smaller diameter than the diameter of the tubing as it exists when initially placed over the connector-heater cable-lead wire section. This characteristic is referred to as "heat shrinkable" and the tube is referred to as "heat shrinkable tubing". The heat shrinkable tubing is readily available in the prior art. The plastic heat shrinkable tubing material has sufficient electrical resistance and temperature resistance for the intended application. The tubing is tough and provides more protection from mechanical damage than does silicone. The tubing can be made of sufficient length and positioned so as to overlap both the insulation of the lead wire and the insulation of the heater cable to cover any cuts or holes resulting from tools used for insulation stripping or connector splicing. A preferred material for the tubing is polyvinylidene fluoride, which is rated for these types of heating applications. Of course, other heat shrinkable tubing material could be used depending on the application. For example, a heater of smaller capacity may use a material that is lower rated.

Figure 8A:
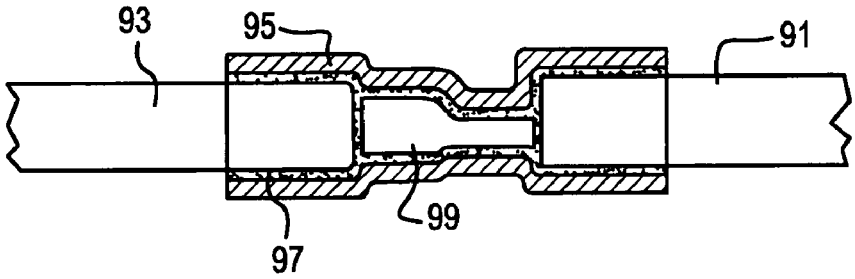
FIGS. 8*a* and 8*b* show schematics of two splice connections of the invention, one with a lead wire of diameter matching the heater cable, and one with a lead wire with a diameter less than that of the heater cable.
Figure 8B:
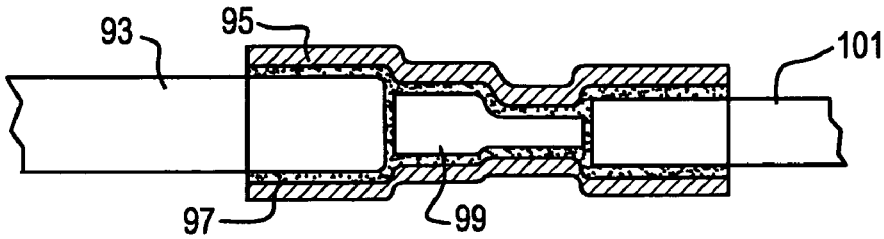

FIGS. 8*a* and 8*b* are schematic and more detailed views of the connector splice area. FIG. 8*a* shows a connection between a lead wire 91 and a heater cable 93. A terminal connector 99 electrically connects the core wire that is part of the heater cable 93 with the strands that are part of the lead wire 91. The heat shrinkable tubing 95 is shown surrounding the ends of the heater cable 93 and lead wire 91. It should be noted that the lead wire insulation may be either silicone or any other material suitable for the application.

An adhesive material 97 is employed that covers the splice connector area and is contained by the heat shrinkable tubing 95. The adhesive material 97 preferably does not bond with the silicone insulation of the heater cable 93 and may or may not bond with the insulation of the lead wire 91, depending on what type of lead wire is employed. One example of an adhesive for use as part of the splice connection is a thermoplastic adhesive or hot melt adhesive, known as Macromelt adhesive with designation TPX-20-239 and made by Macromelt Adhesive. The adhesive is rated high enough for the heater application and it bonds with the inner surface of the heat shrinkable tubing 95. The adhesive has the property of melting during the heating used to collapse the heat shrinkable tubing around the connector splice section. This adhesive has such properties that at heater operating temperatures it neither hardens and breaks nor runs out of the area. The adhesive also retains its properties and thereby forms a seal where the inner surface of the heat shrinkable tubing 95 contacts the outer diameter of both the heater cable wire insulation and the lead wire insulation. Though not necessary, the adhesive can be used in sufficient quantities that, after the shrinking process is completed, sufficient adhesive is present to completely coat the splice area and fill cavities between the inner surface of the heat shrinkable tubing and the outer surfaces of the splice area. However, the presence of entrapped air bubbles around the splice area is not detrimental to the seal. The resulting splice connection and the adjacent wire insulation are sealed from the metal sheath and the environment, whether cuts or holes are present in the insulation or not, thereby preventing failures.

FIG. 8*b* shows the splice connection with a lead wire 91 of different diameter. It should be understood that a variety of diameters or different thicknesses of insulation can be employed for the lead wire. This offers a significant advantage, because a lead wire with an insulation tougher than silicone and thinner in thickness can be employed, thus saving money while reducing the chances of cutting through the insulation during the splicing operation.

The lead wire insulation when not using silicone is preferably a cross-linked polymer such as a polyvinyl chloride. It should be understood that the invention is not limited to a specific adhesive composition, specific heat shrinkable tubing composition, or lead wire insulation composition. More importantly, the materials making up the adhesive should be able to bond with the tubing, and bond or not bond with lead wire and/or heater cable insulation as desired. In addition, the lead wire insulation could be any type, including silicone and non-silicone types.

As noted above and in order to prevent cutting of the heat shrinkable tube, the specially shaped section 50 of FIG. 6 is formed near each end of the metal sheath prior to enclose the heater cable assembly. The special section is of sufficient length and positioned so as to align with the heat shrinkable tubing once the metal sheath is formed around the heater cable assembly. Further manufacturing steps as described previously for the prior art heater will complete manufacture of the new invention model heater.

The invention is also advantageous when the lead wire can be made of a material that bonds to the adhesive. In instances where the lead wires is coated with an insulation that bonds to the adhesive, pull forces applied between the metal sheath and the lead wire will be borne primarily by the heat shrinkable tube rather than the connection of the wires and connector. This is a result of the metal sheath exerting sufficient compressive force upon the heat shrinkable tubing and that portion of the heater cable covered by the tubing so as to isolate the wire connection from the majority of the aforementioned pull force. It matters not whether the adhesive bonds to the heater cable or not. The pull force is thereby borne by the bond between the lead wire insulation and the heat shrinkable tubing, transmitted along the tubing length and then transmitted to the heater cable insulation by the compressive force created by the metal sheath against the heat shrinkable tubing and the heater cable insulation.

Features of the new invention include but are not limited to the following:

1) a heat shrinkable tube covering the splice connector region that is tougher and more resistant to mechanical damage than the molding compounds used in the prior art for covering the splice connector region and an adhesive that bonds to the heat shrinkable tube.

2) A heat shrinkable tube as described above covering the splice connector area and part of the adjacent wires of metal sheathed heaters made with heater cable insulation that is dissimilar from the lead wire insulation; sealing occurs using an adhesive that will not bond with at least one of the insulation materials.

3) A heat shrinkable tube as described above covering the splice connector area and part of the adjacent wires of metal sheathed heaters made with heater cable insulation that is dissimilar from the lead wire insulation; sealing occurs using an adhesive that will not bond with either of the insulation materials.

4) A heat shrinkable tube as described above covering the splice connector area and part of the adjacent wires of metal sheathed heaters made with heater cable insulation that is the same as the lead wire insulation; sealing occurs using an adhesive that will not bond with the insulation material.

5) A heat shrinkable tube as described above covering the splice connector area and part of the adjacent wires of metal sheathed heaters made with heater cable insulation that is the same as the lead wire insulation; sealing occurs using an adhesive that bonds with the insulation material.

6) A heat shrinkable tube as described above covering the splice connector area and part of the adjacent wires of metal sheathed heaters made with heater cable insulation that is different than the lead wire insulation; sealing occurs using an adhesive that bonds with both of the insulation materials.

7) A heat shrinkable tube as described above covering the splice connector area and part of the adjacent wires of metal sheathed heaters where the lead wire is a smaller diameter than the heater cable and the adhesive bonds to the lead wire and to the shrinkable tube forming a seal; pressure of the shrinkable tube against the heater cable insulation produced by the metal sheath and the aforementioned seal creates a resistance to pull forces on the splice connector joint.

8) A heat shrinkable tube as described above with sufficient toughness, temperature resistance, dielectric strength and electrical resistance enclosing the connector splice area that prevents any defects in either the connector splice or the adjacent wire insulation from creating an electrical path to the metal sheath eliminating defective heaters.

9) Dissimilar insulation on the lead wire as compared to the heater core wire allows for tougher lead wire insulation resulting in resistance to abrasion and thinner insulation thickness than otherwise would be the case if the same insulation type were used.

The following Table better summarizes the options listed in the paragraphs 2–7 above, where it should be understood that the adhesive bonds to the heat shrinkable tubing in all cases.

TABLE

| Par. No. | Bonding Arrangement |
|---|---|
| 2 | Adhesive does not bond to one or both of lead wire and heater cable insulation, each having different insulation |
| 3 | Adhesive does not bond to both of lead wire and heater cable insulation, each having different insulation |
| 4 | Adhesive does not bond to both of lead wire and heater cable insulation, each having the same insulation |
| 5 | Adhesive bonds to both of lead wire and heater cable insulation, each having the same insulation |
| 6 | Adhesive bonds to both of lead wire and heater cable insulation, each having different insulation |
| 7 | Adhesive bonds to the heat shrink tubing and smaller diameter lead wire |

Other variations not specifically detailed above but obvious to those skilled in the art are not excluded from this invention of the use of heat shrinkable tubing for a splice connection for a metal sheathed heater.

As such, an invention has been disclosed in terms of preferred embodiments thereof which fulfills each and every one of the objects of the present invention as set forth above and provides a new and improved metal sheathed heater and its method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In an heater having a metal sheath encasing an heater cable, a clamp assembly attached to ends of the metal sheath for securing the metal sheath to a component for heating purposes, lead wires, and a connection where each end of the heater cable connects to a respective end of each lead wire, the improvement comprising a layer of thermoplastic adhesive surrounding the connection, and a heat shrinkable tubing surrounding the adhesive layer and being bound to the adhesive layer, the adhesive being in unhardened state and forming a seal when situated between the heat shrinkable tubing and each of an outer surface of the lead wire insulation, an outer surface of the heater cable insulation, and outer surfaces of the connection, the adhesive being a type that either does not bond to the insulation of the lead wire or the insulation of the heater cable so as to form respective unbound regions, or bonds to only one of the insulation of the lead wire or the insulation of the heater cable to leave an unbound region, compression of the metal sheath around the heat shrinkable tubing in the unbound region binding the heat shrinkable tubing to insulation in the unbound region.

2. The heater of claim 1, wherein adhesive is of the type to not bond to the insulation on the lead wire and bond to the insulation on the heater cable.

3. The heater of claim 1, wherein the adhesive is of the type to not bond to the insulation on the heater cable and bond to the insulation on the lead wire.

4. The heater of claim 1, wherein the adhesive does not bond to both the insulation of the heater cable and the insulation on the lead wire.

5. The heater of claim 1, wherein the heater cable has a silicone insulation, and the lead wire has a non-silicone insulation.

6. The heater of claim 1, wherein lead wire has a diameter smaller than a diameter of the heater cable.

7. The heater of claim 5, wherein lead wire has a diameter smaller than a diameter of the heater cable.

8. In an heater having a metal sheath encasing an heater cable, a clamp assembly attached to ends of the metal sheath for securing the metal sheath to a component for heating purposes, lead wires, and a connection where each end of the heater cable connects to a respective end of each lead wire, the improvement comprising a layer of adhesive surrounding the connection, and a heat shrinkable tubing surrounding the adhesive layer and being bound to the adhesive layer, wherein a section of the metal sheath surrounding the heat shrinkable tubing has an enlarged diameter as compared to one or more remaining sections surrounding the heater cable.

9. In a method of making a metal sheathed heater by encasing a heater cable, an end part of each of two lead wires, and a connection wherein each end of the heater cable connects to a respective end of the each lead wire in a metal sheath, the improvement comprising forming an enlarged diameter section in each end portion of the metal sheath to receive each connection.

10. In a method of making a metal sheathed heater by encasing a heater cable, an end part of each of two lead wires, and a connection wherein each end of the heater cable connects to a respective end of the each lead wire in a metal sheath, the improvement comprising forming a splice connection by first applying a thermoplastic adhesive to the connection of each lead wire end with each heater cable end, and then encasing the connection and lead wire and heater cable ends with a heat shrinkable tubing, the adhesive bonding to the heat shrinkable tubing, and wherein the adhesive is in an unhardened state and forms a seal when situated between each of the heat shrinkable tubing and an outer surface of the lead wire insulation, an outer surface of the heater cable insulation, and outer surfaces of the connection, the adhesive being of a type that either does not bond to the insulation of the lead wire or the insulation of the heater cable so as to form respective unbound regions, or bonds to only one of the insulation of the lead wire or the insulation of the heater cable to leave an unbound region, compression of the metal sheath around the heat shrinkable tubing in the unbound region binding the heat shrinkable tubing to insulation in the unbound region.

11. The method of claim 10, further comprising forming enlarged diameter sections near opposite ends of the metal sheath to receive the respective splice connections.

12. The method of claim 10, wherein the adhesive does not bond to the insulation on the lead wire and bonds to the insulation on the heater cable.

13. The method of claim 10, wherein the adhesive does not bond to the insulation on the heater cable and bonds to the insulation on the lead wire.

14. The method of claim 10, wherein the adhesive does not bond to both of the insulation on the lead wire and the insulation of the heater cable.

* * * * *